US005171060A

United States Patent [19]

Kaye

[11] Patent Number: 5,171,060

[45] Date of Patent: * Dec. 15, 1992

[54] ORNAMENT DISPLAYING FURNITURE

[75] Inventor: Howard Kaye, Greenwich, Conn.

[73] Assignee: Designs For Leisure, Ltd., Mount Kisco, N.Y.

[ * ] Notice: The portion of the term of this patent subsequent to May 29, 2007 has been disclaimed.

[21] Appl. No.: 713,860

[22] Filed: Jun. 12, 1991

Related U.S. Application Data

[63] Continuation of Ser. No. 484,795, Feb. 26, 1990, abandoned, which is a continuation-in-part of Ser. No. 270,681, Nov. 14, 1988, Pat. No. 4,929,021.

[51] Int. Cl.[5] ..... A47C 7/00

[52] U.S. Cl. ..... 297/193; 108/23; 108/150; 243/133.1; 297/217; 297/461; 297/463

[58] Field of Search ..... 297/188, 193, 197, 217, 297/439, 461, 463; 108/23, 150, 159, 160; 248/188.1, 188.8; 40/564

[56] References Cited

U.S. PATENT DOCUMENTS

| | | | |
|---|---|---|---|
| 1,846,878 | 2/1932 | Kopp | 108/23 X |
| 2,754,409 | 7/1956 | Zutler | 108/23 |
| 3,624,381 | 11/1971 | Pollack | 108/23 |
| 3,756,169 | 9/1973 | Dybvig | 108/150 |

FOREIGN PATENT DOCUMENTS

| | | | |
|---|---|---|---|
| 1530403 | 9/1968 | France | 108/23 |
| 193800 | 1/1938 | Switzerland | 108/23 |

*Primary Examiner*—Peter R. Brown
*Attorney, Agent, or Firm*—William E. Pelton

[57] ABSTRACT

An ornament displaying article of furniture having a weight-bearing surface member and pedestal base has a supporting substantially cylindrical and preferably transparent column releasably connected to the weight-bearing surface member. The appearance of the column may be altered with an agglomeration or reflective fill material, such as marbles, which may be exchanged by detaching the column from the weight-bearing surface member. In a preferred embodiment a light source irradiates light reflective or light radiant material of the fill.

5 Claims, 2 Drawing Sheets

FIG. 1
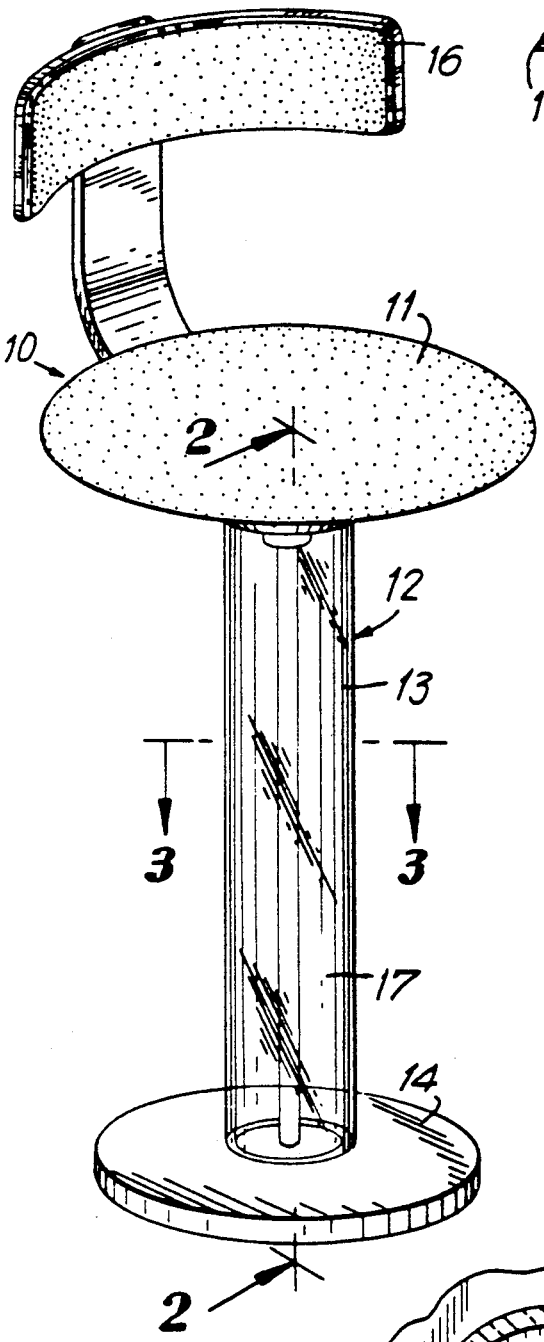
FIG. 2
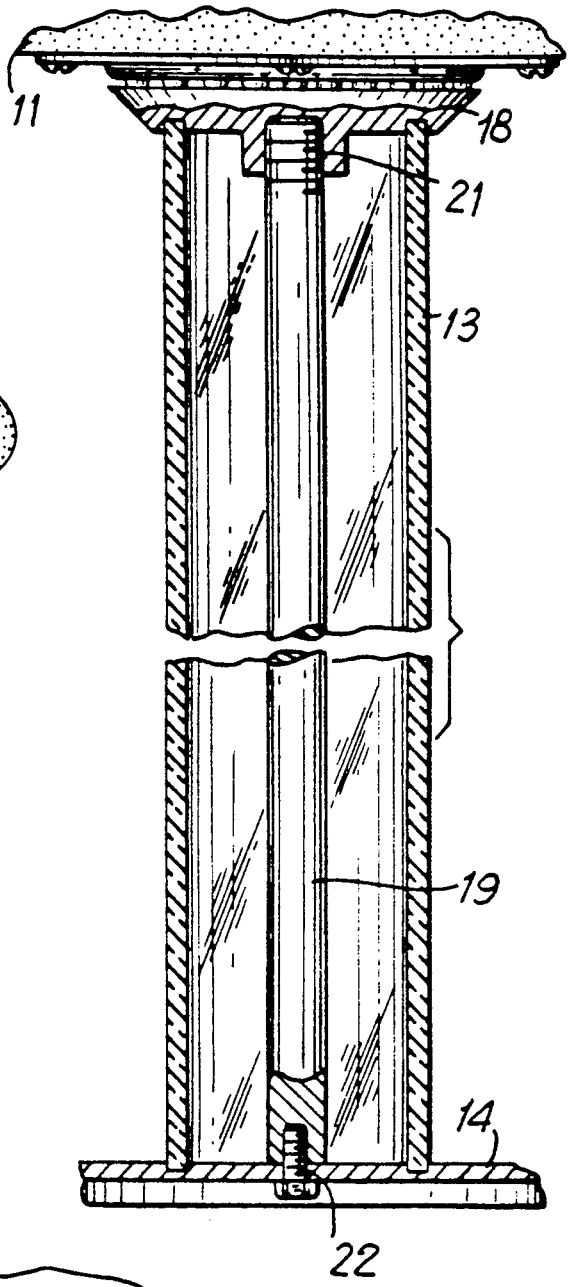
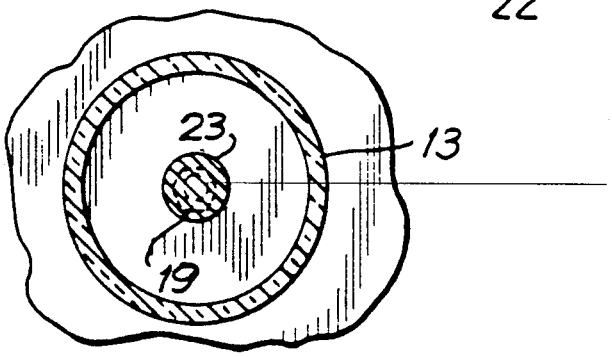
FIG. 3

FIG. 4
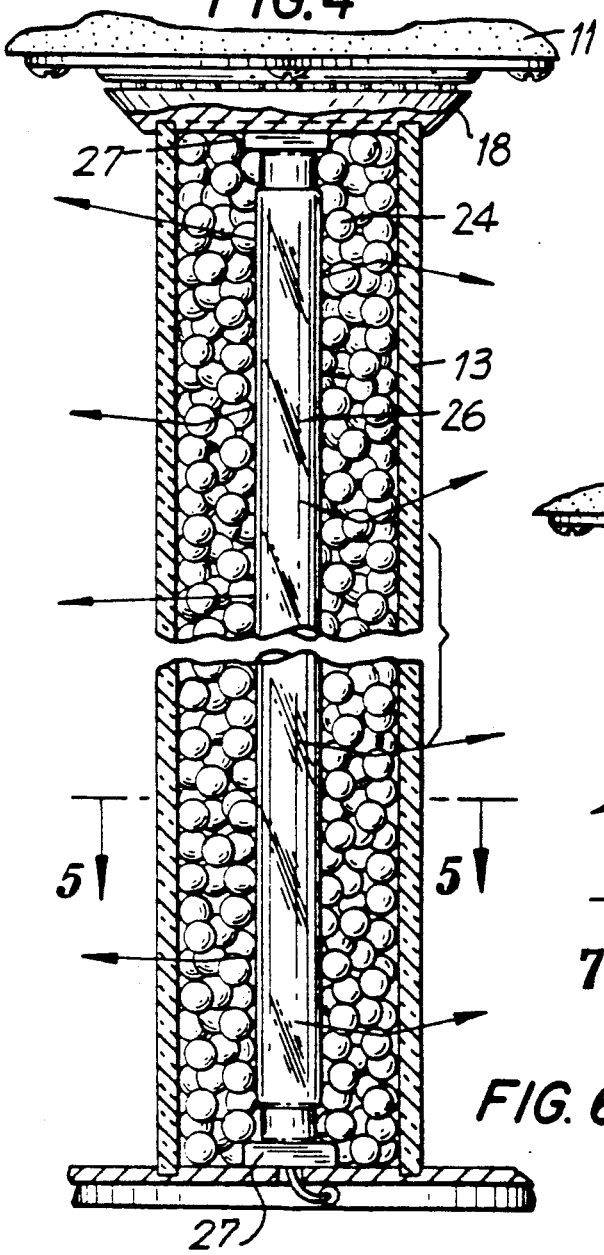
FIG. 5
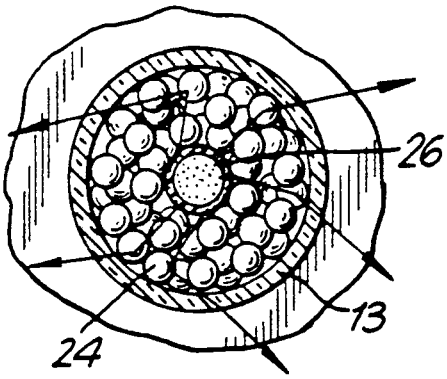
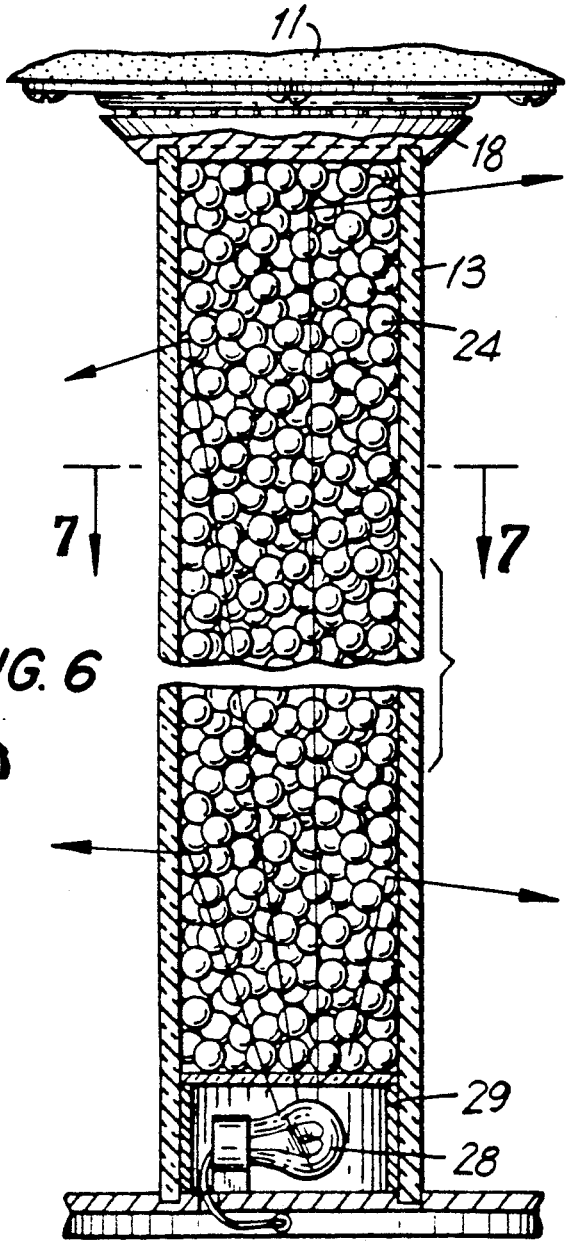
FIG. 6
FIG. 7
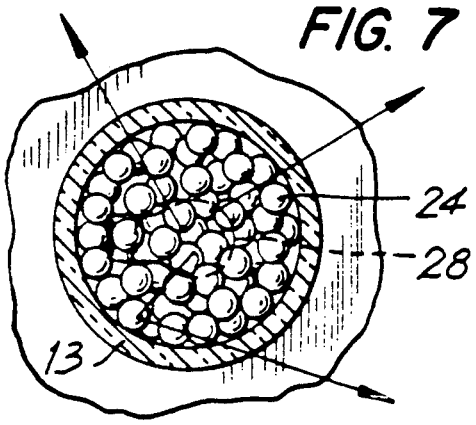

ORNAMENT DISPLAYING FURNITURE

This application is a continuation of U.S. application Ser. No. 484,795, filed Feb. 26, 1990, now abandoned, which is a continuation in part of U.S. application Ser. No. 270,681 filed Nov. 14, 1988 now U.S. Pat. No. 4,929,021.

FIELD OF THE INVENTION

The invention relates to ornament displaying articles and in particular to ornament displaying furniture, including but not limited to a stool and seat structure of the type popular for use at a bar or similar setting, in which the overall appearance of the article may be altered at will by changing the nature of a dominant ornamental feature. Such a feature may, for example, be characterized by a hollow and elongated supporting column with an agglomeration of colorable or light reflective replaceable fill material visible or otherwise discernible therein.

BACKGROUND OF THE INVENTION

Ornament displaying articles have been known heretofore. These have included ornamental coverings or objects carried by the exterior of the article. Decorative features have also been placed within recesses or spaces formed in the article and enclosed by a transparent plastic cover. Such an article is disclosed in U.S. Pat. No. 2,759,284 to F. Santisi. U.S. Pat. No. 3,546,232 to Ellerbe discloses a lighted article of footwear having a battery-carrying heal and an external light bulb for illuminating flashing light sources are also known in the art. See, for example, U.S. Pat. No. 4,158,922. In U.S. Pat. No. 45,811 a transparent or translucent sign is internally illuminated.

U.S. Pat. Nos. 1,846,878 to Kopp, 2,754,409 to Zutler, 3,624,381 to Pollack and 3,756,169 to Dybvig may also be pertinent to articles of the type described herein. For example, Dybvig shows a pedestal mounted seat while Kopp, Zutler and Pollack disclose transparent supports with lights therein.

In addition, Swiss patent 193800 to Hinnen and French patent 1530403 to Fienga are also thought to be pertinent. Fienga discloses a transparent element with lights therein while Hinnen shows a transparent cylindrical support column containing supports and light bulbs. Hinnen however fails to disclose ornamental material within its center column and could not be used to contain an agglomeration of decorative material as characterizes applicant's invention.

With respect to furniture, various ornament displaying features are known but the ability to alter at will the overall appearance of an article of furniture by changing a dominant ornamental feature has not been known heretofore. Accordingly, it is the principal object of the present invention to provide an article of furniture, such as a chair, table or, in particular a barstool, which is characterized by an agglomeration of alterable ornamental features.

SUMMARY OF THE INVENTION

In accordance with the present invention, an article of furniture such as a barstool is provided with a separable element adapted to contain an agglomeration of an exchangeable fill material visible or discernible therein. The fill material may be light radiant or light reflective or absorbative material and may be colored as desired to suit the requirements of a selected overall ornamental appearance for the article. In the preferred embodiment, the article of furniture is a high-end designer barstool having a hollow pedestal support at least a portion, and preferably all, of which is transparent to the interior cavity. Decorative elements such as a cylindrical brass core coaxial with the support or a plurality of colored marbles may be provided within the pedestal. In one embodiment, the pedestal is releasably affixed to the seat portion of the barstool so that the hollow interior may be emptied or refilled at will. A light source may be positioned at one end of, or extended axially throughout, the interior cavity, so as to illuminate the reflective fill material to project a desired "look".

BRIEF DESCRIPTION OF THE DRAWINGS

For a further understanding of the present invention, reference may be had to the accompanying drawings in which:

FIG. 1 is a perspective side elevational view of a stool in accordance with the present invention.

FIG. 2 is a sectional view along the line 2—2 of FIG. 1;

FIG. 3 is a sectional view along the line 3—3 of FIG. 1;

FIG. 4 is a sectional view along the line 2—2 of FIG. 1, showing a modification of the invention;

FIG. 5 is a sectional view along the line 5—5 of FIG. 4;

FIG. 6 is a sectional view corresponding to of FIG. 4 but of another modification of the invention; and FIG. 7 is a sectional view along the line 7—7 of FIG. 6;

BRIEF DESCRIPTION OF THE PREFERRED EMBODIMENTS

Referring now to the drawings, and in particular to FIG. 1, there is shown an article of furniture depicted for illustration only as a stool 10 having a weight bearing surface in the form of a conventional cushioned seat 11 affixed at the top of a stool support section 12. Such a seat may, of course, take any known configuration whether cushioned or not cushioned. In the present embodiment, the stool support 12 is a vertical tubular member or column 13 suitably connected to a base element 14, which may be a circular plate having a flat bottom for resting stably on the floor. Where desirable, the seat 11 may be provided with a back support characterized in the present embodiment by a substantially vertically extending metal support arm 14 which carries a cushioned, curved back-contacting member 16. It will be understood that the nature and configuration of the seat and back support may be varied, as desired, without departing from the scope of the present invention. While this embodiment depicts the weight bearing surface as a seat it could be a table top of any suitable size or configuration without departing from the scope of the invention. Indeed, the present invention is not to be limited by the nature of the article of furniture.

The tubular support member 13 is preferably cylindrical in cross-section to form a hollow vertical column and may be formed of substantially transparent plastic such as a commonly available polymer widely known as LUCITE and popularly used for its strength and texture. The tubular or cylindrical configuration for the stool support 13 is shown by way of example only and the invention is not to be limited thereby. At least a portion of the column 13 is hollow or formed with an ornament carrying internal cavity, such as the cavity indicted by reference numeral 17, although the entire cylindrical column 13 is indicated as hollow for purposes of illustration. In the present embodiment, the hollow interior 17 of the column 13 is visible because of the transparency of the LUCITE material utilized for the column, although it need not be transparent along its entire length or around its entire periphery but generally only substantially coextensively with the desired size of the interior cavity 17. Of course, the LUCITE material may be translucent and not transparent, as desired, or may be a combination of both thereby permitting the passage of light either in its entirety or through selected areas created by design.

Referring now to FIG. 2, the seat 11 may be rotatably connected at one side of a suitable metal seat-supporting casting 18 which is mounted with its other side resting flush against the top end of the cylindrical support 13. The side peripheral edges of the casting 18 may be bevelled as shown to provide an ornamental appearance, as desired. In the present embodiment, the seat releasably engages the casting 18 in a conventional manner so that it and the casting may be removed from the end of the support column 13 to expose the hollow interior thereof. It will be understood by those skilled in this art, that a variety of mechanical techniques may be used for releasably interconnecting the set and support column without departing from the scope of the present invention.

In the preferred embodiment, the seat-supporting casting 18 and the base plate 14 are held together by an elongated metal rod 19 which extends axially through the cylindrical column 13 substantially along its longitudinal axis from top to bottom. The upper end of the rod 19 may be provided with screw threads 21 adapted threadedly to engage a cooperating threaded bore formed in a suitable inwardly directed protuberance of the casting 18. Alternatively, the rod 19 may pass through an opening formed in the casting 18 to be threadedly engaged by a suitable nut, such as a wing nut, not shown. Yet another fastening technique which may be employed, where desired, is to provide a suitable threaded bore axially in one or both of the ends of the rod 19 so as threadedly to receive a cooperating screw bolt 22 inserted therein from the opposite side of, for example, the base plate 14, as depicted in FIG. 2. The various ways of releasably securing the base plate 14, supporting column 13 and seat 11 together will be well understood by those skilled in the art and may be adapted to furniture of the present invention without departing from its legitimate scope. It should also be noted that the base 14 may be releasably connected to the column 13 to enable the column interior to be refilled from the bottom end of the stool, as desired.

With reference to FIG. 3, a stool of the present invention may contain a visible or otherwise discernible ornamental feature within the hollow interior 17 of the transparent cylindrical support 13. In this embodiment, the ornamental feature may comprise a cylindrical ornamental sleeve 23 which is placed within the column 13 around and coaxially with the interconnecting rod 19. In a preferred embodiment, for example, the sleeve 23 is shown to be cylindrical and of substantially constant diameter, although these parameters may be varied, as desired to achieve different ornamental appearances. Indeed, a plurality of such sleeves of different shapes, sizes colors and materials may be obtained and interchanged, simply by removing the seat and exchanging one sleeve for another, in order to vary the ornamental appearance of the stool.

Referring to FIGS. 4 to 7, the stool of the present invention is shown having a visible or discernible agglomeration of replaceable ornamental or decorative elements or effects within the hollow interior 17 of the cylindrical support 13. For example, the interior 17 of the cylindrical column 13 may be filled with an agglomeration or congregate of light reflective materials such as ball elements or marbles 24 of various sizes, designs and color so that light from a source external to the stool will be reflected back from the material within the hollow column thereby to display a pleasing ornamental appearance. Other decorative material may be used within the column 13 to alter the appearance of the stool at will without departing from the scope of the present invention. To do so, it is only necessary to remove the seat 11 from the top of the column 13, pour out the fill which may be ball elements or marbles and replace such material with other decorative elements of choice. When such an agglomeration of decorative elements is used such elements are generally packed together within the closed volume of the hollow support 13. The composite of such materials extends radially outwardly in all directions against, and may be retained by the inner surface of the sidewalls of the hollow support. Thus the configuration of the agglomerated material may be essentially cylindrical if the hollow support is a cylinder or may take some other shape such as square or rectangular for example if the hollow support 13 is not cylindrical. Basically the hollow interior of the support 13 defines the closed volume which may be filled or partially filled as desired with the agglomerate material. When desired the decorative agglomerate or fill material may be placed within the hollow support 13 in multicolored layers or in other decorative and attractive arrangements.

FIGS. 4 and 5 also illustrate a type of internal lighting which may be utilized to enhance the ornamental display or design appearance of the stool. In this embodiment, the axially extending rod 19 and surrounding sleeve 23 may be omitted and other conventional techniques utilized for releasably securing the seat; base plate and support column together. One or more fluorescent light bulbs 26 may be provided substantially along the centerline of the column 13, as shown. Suitable electrical connections 27 are provided at each end of the column and may be attached to the seat base and to the stool base electrically to engage opposite ends respectively of the fluorescent lighting fixtures. Such lighting may be utilized with or without light reflective ball elements 24. Of course, fill material which might cause breakage of the light bulbs should not be used without adequate protection for the bulbs. It should also be understood that the central rod 19 need not be eliminated where light reflective fill material is used together with the fluorescent light as shown in FIG. 4. Appropriate fluorescent lights may extend inwardly adjacent the rod 19. The fill material 24 will obscure their actual presence but will permit radiant light to accent the shapes and colors in a desirable way.

FIGS. 6 and 7 illustrate another form of internal lighting, characterized by a incandescent light bulb 28 located at one end, for example the bottom, of the support column 13. Such a bulb may be placed within a suitable protective enclosure or shield 29 which has one or more light transmitting openings (not shown) at the top facing longitudinally inwardly along the length of the support column 13. Light from the bulb 28 is thereby transmitted longitudinally through the column reflecting from the colored fill material and thence outwardly through the sides of the column, as illustrated by the arrows shown in FIG. 7. In this embodiment, the light transmitting openings above the light bulb 28 may be ordinary transparent or desirably colored glass or plastic pane or may comprise one or more lenses, such as the lens 32, which are supported above the light bulb. The materials the sizes, shapes and color of lenses may be varied in order to change the decorative affect of the nature of the light transmitted in a desired fashion. Such a source of light may also be used to illuminate one or a plurality of light transmitting optical fibers (not shown) dispersed and arranged attractively at will throughout the interior of the column 13. In addition, while the fill material has been described herein by way of illustration as ball-like elements, it will be apparent that other suitable transparent or light reflective fill or structures may be placed within the hollow column 13 so as to form an agglomeration of fill materials that constitute a pleasing illuminated pedestal for the bar stool.

Other modifications may be made by persons having ordinary skill in the art to the structure and embodiments described herein without departing from the scope of the invention, which is not to be limited except by the scope of the following claims.

What is claimed is:

1. An ornament displaying article of furniture comprising a weight-bearing surface member consisting of a seat adapted to accommodate a sitting person, a floor contacting surface and a support element between said floor contacting surface and said seat, said support element having a hollow display section defining an interior closed volume, a replaceable ornamental display within said closed volume consisting of an agglomeration of decorative materials, said display section having a light transmitting portion through which said materials are visible from outside the article of furniture, and a light source within said closed volume adapted to provide light incident on said decorative materials.

2. The article of claim 1, in which said source of light is positioned at one end of said support element and is placed within a protective enclosure which has one or more light transmitting openings at the top wherein the light is transmitted in a substantially longitudinal inward direction along the length of said support element.

3. The article of claim 2, comprising in addition a lens positioned between said source of light and said closed volume within one of said light transmitting openings of said protective enclosure so as to direct light inward along the length of said support element.

4. The article of claim 1, in which said source of light comprises a light radiant tube, said tube extending within said closed volume substantially coaxially with said support element.

5. An ornament displaying article of furniture comprising a pedestal portion, a base section connected to said pedestal portion and having a floor contacting surface, the diameter of said base section at the floor being larger than the diameter of said pedestal portion, a display section formed as part of said pedestal portion and having a hollow portion defining a closed interior volume, and means for attaching said pedestal portion to the undersurface of a weight-bearing furniture component having a diameter larger than the diameter of said pedestal portion, said hollow display section being releasably connected to one of said weight-bearing furniture component and said base section; a replaceable ornamental display within said closed interior volume of said hollow display section, said ornamental display consisting of an agglomeration of decorative materials substantially filling from wall to wall the volume of that portion of said hollow display section in which they are retained, said hollow display section having a light transmitting portion through which said materials are visible from outside the article of furniture and changeable upon releasing one of said weight-bearing furniture component and base section from said hollow display section.

* * * * *